US008721395B2

(12) United States Patent
Wu et al.

(10) Patent No.: US 8,721,395 B2
(45) Date of Patent: May 13, 2014

(54) ABRASIVE TOOL WITH FLAT AND CONSISTENT SURFACE TOPOGRAPHY FOR CONDITIONING A CMP PAD AND METHOD FOR MAKING

(75) Inventors: Jianhui Wu, Ashland, MA (US); Guohua Zhang, Northborough, MA (US); Richard W. J. Hall, Southborough, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 0 days.

(21) Appl. No.: 13/384,331

(22) PCT Filed: Jul. 16, 2010

(86) PCT No.: PCT/US2010/042267

§ 371 (c)(1), (2), (4) Date: Jan. 16, 2012

(87) PCT Pub. No.: WO2011/009046

PCT Pub. Date: Jan. 20, 2011

(65) Prior Publication Data

US 2012/0122377 A1 May 17, 2012

Related U.S. Application Data

(60) Provisional application No. 61/232,040, filed on Aug. 7, 2009, provisional application No. 61/226,074, filed on Jul. 16, 2009.

(51) Int. Cl.
*B24B 53/00* (2006.01)

(52) U.S. Cl.
USPC ..... 451/56; 451/443

(58) Field of Classification Search
USPC ..... 451/443, 444, 56, 72, 21
See application file for complete search history.

(56) References Cited

U.S. PATENT DOCUMENTS

| | | | | |
|---|---|---|---|---|
| 5,069,978 | A | 12/1991 | Mizuhara | |
| 5,352,493 | A | 10/1994 | Dorfman et al. | |
| 6,004,362 | A * | 12/1999 | Seals et al. | 51/295 |

(Continued)

FOREIGN PATENT DOCUMENTS

| | | | |
|---|---|---|---|
| CN | 1180932 | A | 5/1998 |
| CN | 101123242 | A | 2/2008 |

(Continued)

OTHER PUBLICATIONS

Written Opinion and International Search Report from PCT Application No. PCT/US10/042267, Filed Jul. 16, 2010 (8 pgs).

*Primary Examiner* — Robert Rose
(74) *Attorney, Agent, or Firm* — Joseph P. Sullivan; Abel Law Group, LLP

(57) ABSTRACT

An abrasive tool with flat and consistent surface topography for conditioning a CMP pad and method for making are disclosed. The abrasive tool includes abrasive grains coupled to a low coefficient of thermal expansion (CTE) substrate through a metal bond. There is an overall CTE mismatch that ranges from about 0.1 μm/m-° C. to about 5.0 μm/m-° C. The overall CTE mismatch is the difference between the CTE mismatch of the abrasive grains and the metal bond and the CTE mismatch of the low CTE substrate and the metal bond.

17 Claims, 10 Drawing Sheets

(56) References Cited

U.S. PATENT DOCUMENTS

| | | | |
|---|---|---|---|
| 6,755,720 | B1 | 6/2004 | Ishizaki et al. |
| 2004/0185763 | A1 | 9/2004 | Ishizaki et al. |
| 2006/0079162 | A1 | 4/2006 | Yamashita et al. |
| 2006/0254761 | A1 | 11/2006 | Watanabe et al. |
| 2008/0131723 | A1 | 6/2008 | Tucker et al. |
| 2008/0193649 | A1 | 8/2008 | Jacquet et al. |
| 2009/0325472 | A1 | 12/2009 | Wu et al. |
| 2010/0330886 | A1 | 12/2010 | Wu et al. |

FOREIGN PATENT DOCUMENTS

| | | | |
|---|---|---|---|
| JP | 6071503 | A | 3/1994 |
| JP | 06-126637 | A | 5/1994 |
| JP | 09-019789 | B2 | 1/1997 |
| JP | H10-015833 | | 1/1998 |
| JP | 10128668 | A | 5/1998 |
| JP | H10-113875 | | 5/1998 |
| JP | 3102715 | B2 | 10/2000 |
| JP | 2001062601 | | 3/2001 |
| JP | 2001239461 | | 9/2001 |
| JP | 2003-229390 | A | 8/2003 |
| JP | 2003-309094 | | 10/2003 |
| JP | 2004-059367 | A | 2/2004 |
| JP | 2006-116692 | | 5/2006 |
| JP | 4089951 | B2 | 5/2008 |
| JP | 2009-016484 | A | 1/2009 |
| JP | 2009-136926 | A | 6/2009 |
| WO | 90/04490 | A1 | 5/1990 |
| WO | 97/06339 | A1 | 2/1997 |
| WO | 2005116146 | A2 | 12/2005 |

* cited by examiner

10

FLTt = 87.38 µm
FLTp = 22.17 µm
FLTv = 65.21 µm
FLTq = 11.8 µm

70

80

85

90

100

110

ABRASIVE TOOL WITH FLAT AND CONSISTENT SURFACE TOPOGRAPHY FOR CONDITIONING A CMP PAD AND METHOD FOR MAKING

CROSS REFERENCE TO RELATED APPLICATIONS

The present application claims priority from PCT Application No. PCT/US10/042,267, filed Jul. 16, 2010, entitled "ABRASIVE TOOL WITH FLAT AND CONSISTENT SURFACE TOPOGRAPHY FOR CONDITIONING A CMP PAD AND METHOD FOR MAKING," naming inventors Jianhui Wu, Guohua Zhang, and Richard W. J. Hall, which in turn claims priority to U.S. Provisional Patent Application Ser. No. 61/226,074 filed on Jul. 16, 2009, entitled "ABRASIVE TOOL WITH FLAT AND CONSISTENT SURFACE TOPOGRAPHY FOR CONDITIONING A CMP PAD AND METHOD FOR MAKING", naming inventors Jianhui Wu, Guohua Zhang, and Richard W. J. Hall, and U.S. Provisional Patent Application Ser. No. 61/232,040 filed on Aug. 7, 2009, entitled "ABRASIVE TOOL WITH FLAT AND CONSISTENT SURFACE TOPOGRAPHY FOR CONDITIONING A CMP PAD AND METHOD FOR MAKING", naming inventors Jianhui Wu, Guohua Zhang, and Richard W. J. Hall, which are all incorporated by reference herein in their entirety.

BACKGROUND

The present invention relates generally to abrasive tools and more particularly to an abrasive tool with flat and consistent surface topography for conditioning a chemical-mechanical polishing or chemical-mechanical planarization (CMP) pad and method for making the tool.

CMP processes are carried out to produce flat (planar) surfaces on a variety of materials including semiconductor wafers, glasses, hard disc substrates, sapphire wafers and windows, plastics and so forth. Typically, CMP processes involve using a polymeric pad (CMP pad) and a slurry that contains loose abrasive particles and other chemical additives to remove material to reach designed dimension, geometry, and surface characteristics (e.g., planarity, surface roughness) by both chemical and mechanical actions.

During a typical CMP process, the CMP pad becomes glazed with polishing residue. This necessitates the use of a CMP conditioner (also referred to as a CMP dresser) to condition or dress the CMP pad in order to eliminate the glazing and residue. Eliminating the glazing and residue allows the CMP pad to deliver stable polishing performance.

Generally, a CMP conditioner is fabricated by using a metal bond to fix abrasive particles to a preform to create an abrasive tool with a working surface that can condition CMP pads. The flatness and topography of the working surface can dictate how well a CMP conditioner conditions a CMP pad. A CMP conditioner with a working surface that is not flat and inconsistent in its topography will cut and/or damage the CMP pad. This type of topography eventually affects the ability of the CMP pad to provide consistent and uniform polishing during the CMP process. Additionally, in applications where a CMP pad is used to polish semiconductor wafers, a cut and/or damaged pad will affect the yield of integrated circuit chips formed from a wafer.

SUMMARY

In one embodiment, there is an abrasive tool comprising: abrasive grains coupled to a low coefficient of thermal expansion (CTE) substrate through a metal bond, wherein there is an overall CTE mismatch that ranges from about 0.1 μm/m-° C. to about 5.0 μm/m-° C., wherein the overall CTE mismatch is the difference between the CTE mismatch of the abrasive grains and the metal bond and the CTE mismatch of the low CTE substrate and the metal bond.

In a second embodiment, there is a method of forming an abrasive tool comprising: providing a low coefficient of thermal expansion (CTE) substrate as a preform; applying a metal bond to the low CTE substrate; applying abrasive grains to the metal bond to form an as-made abrasive tool, wherein there is an overall CTE mismatch that ranges from about 0.1 μm/m-° C. to about 5.0 μm/m-° C., wherein the overall CTE mismatch is the difference between the CTE mismatch of the abrasive grains and the metal bond and the CTE mismatch of the low CTE substrate and the metal bond; drying the as-made abrasive tool in an oven; and firing the as-made abrasive tool in a furnace at a predetermined firing temperature to form the abrasive tool.

In a third embodiment, there is a method of conditioning a chemical-mechanical polishing (CMP) pad that comprises: contacting a working surface of the CMP pad with an abrasive tool, wherein the abrasive tool comprises abrasive grains coupled to a low coefficient of thermal expansion (CTE) substrate through a metal bond, wherein there is an overall CTE mismatch that ranges from about 0.1 μm/m-° C. to about 5.0 μm/m-° C., wherein the overall CTE mismatch is the difference between the CTE mismatch of the abrasive grains and the metal bond and the CTE mismatch of the low CTE substrate and the metal bond.

DETAILED DESCRIPTION OF THE EMBODIMENTS

Figure 1:
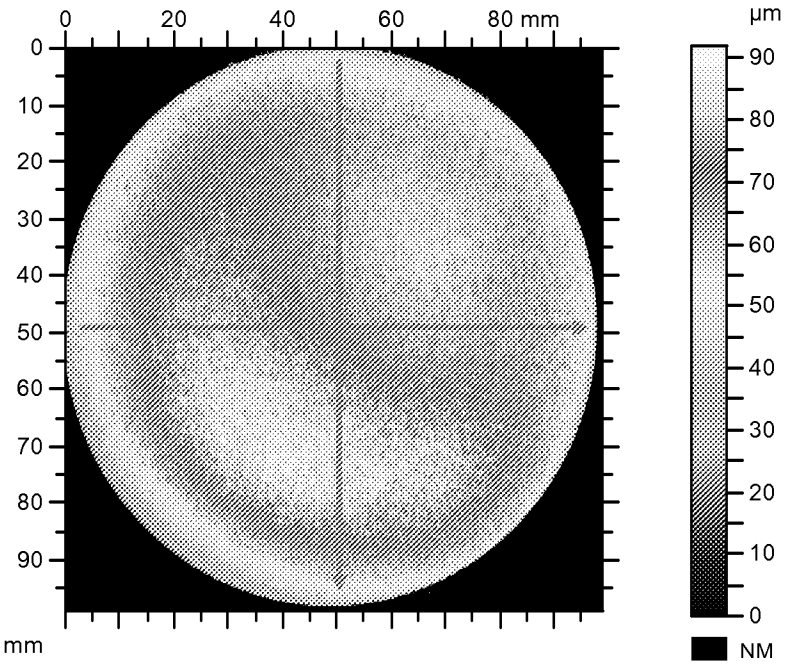
Prior Art FIG. 1
FIG. 1 is an image of a conventional abrasive tool having a non-flat and inconsistent surface topography.

Embodiments of the present invention described herein relate to an abrasive tool such as a chemical-mechanical polishing or chemical-mechanical planarization (CMP) conditioner or dresser that is used to condition or dress a CMP pad to eliminate glazing and residue from the pad, so that the pad can deliver stable polishing performance during a CMP process. It has been determined herein that conventional CMP conditioners fabricated with a stainless steel substrate with a metal alloy layered (e.g., brazing materials and metal powder bond materials) on the substrate and abrasive grains layered on the metal alloy are susceptible to having a working surface that is non-flat and inconsistent in its topography. As mentioned above, this affects the ability of a CMP pad to provide consistent and uniform polishing during a CMP process.

The non-flat and inconsistent surface topography for CMP conditioners fabricated from a stainless steel substrate preform with a metal alloy and abrasive grains arises in the firing process of producing the conditioners. In particular, the stainless steel substrate preform with metal alloy and abrasive grains are placed in a vacuum furnace heated at a predetermined temperature, which causes the metal alloy to expand and react with the stainless steel substrate and abrasive grains and form a metal bond between each interface (i.e., the interface of the abrasive grains and metal alloy and the interface of the stainless steel substrate and metal alloy). Once the temperature cools, then the stainless steel substrate, metal bond and abrasive grains begin to shrink and solidify. Because the stainless steel substrate has a higher coefficient of thermal expansion (CTE) than the CTE of the composite layer formed from the metal alloy and abrasive grains, the expanding and shrinking of the stainless steel substrate and the composite layer of the metal alloy and abrasive grains will happen at a different rate. In particular, the stainless steel substrate will expand and shrink at a faster rate than the composite layer formed from the metal alloy and abrasive grains because of the mismatch in CTEs. This mismatch in CTEs causes a thermal deformation in that there is a compression that occurs between the stainless steel substrate and the composite layer formed of the metal alloy and abrasive grains. This results in the composite layer having a convex surface topography (i.e., the center is higher than the edges) due to the faster shrinking rate of the stainless steel substrate with respect to the slower shrinking rate of the composite layer as the temperature in the furnace cools down to room temperature. A CMP conditioner that has a convex surface topography will wear quickly at the center because it is performing the majority of the conditioning at this location as opposed to the edges which are lower. A CMP conditioner with a surface topography that is non-flat and inconsistent because of the convex shape will condition a CMP pad in a non-uniform manner. Consequently, any polishing functions performed by the CMP pad will be inconsistent resulting in quality (e.g., defectivity) and yield issues.

Attempts have been made to correct the convex surface topography that arises from thermal deformation in the firing process of the CMP conditioners by using a mechanical pressing process. In particular, a load (e.g., up to 10,000 lbs) is applied to the working surface (i.e., abrasive grains) to push the convex part from near the center back to a flat shape. However, the load from the mechanical pressing process provides a non-uniform force on the abrasive grains and as a result is unable to satisfactorily correct the surface topography of the CMP conditioners.

FIG. 1 is an image 10 of a conventional abrasive tool that has undergone the mechanical pressing process. As shown by the various shades in image 10, the surface topography is uneven and non-uniform because some deformation still remains even after performing the mechanical pressing process. Because the CMP conditioners still have non-flat and inconsistent surface topographies even after undergoing a mechanical pressing process, a need exists to prevent the thermal deformation from occurring in the firing process of CMP conditioners.

It has been determined herein that the thermal deformation can be minimized by using a substrate that has a CTE that more closely matches the CTE of the abrasive grains. In particular, it is proposed to use a substrate that comprises a low CTE material that closely matches the CTE of the abrasive grains. The use of a low CTE material for the substrate obviates the CTE mismatches caused by using a stainless steel substrate that has been determined herein as a cause for CMP conditioners having a working surface that is non-flat and inconsistent in topography.

Figure 2:
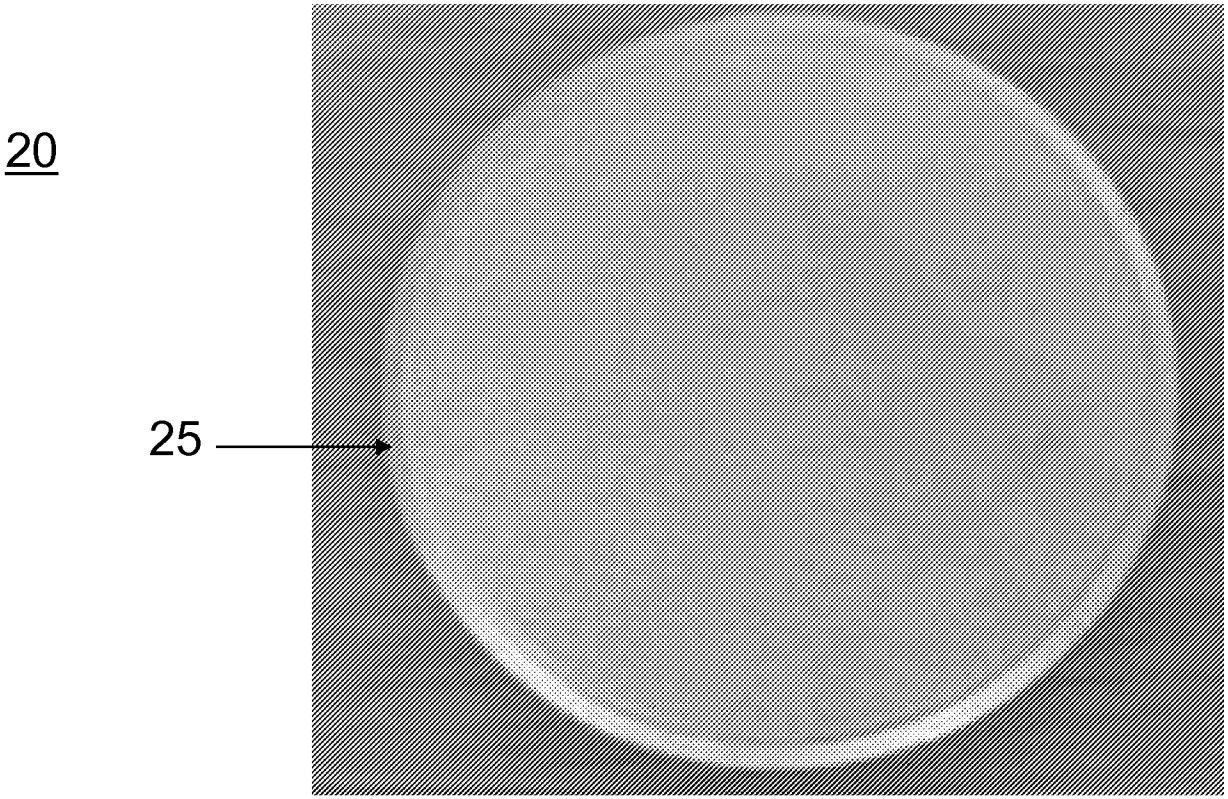
FIG. 2 is an image of an abrasive tool according to one embodiment of the present invention.

FIG. 2 is an image 20 of an abrasive tool 25 according to one embodiment of the present invention. In one embodiment, abrasive tool 25 comprises abrasive grains coupled to a low CTE substrate through a metal bond, wherein there is an overall CTE mismatch that ranges from about 0.1 μm/m-° C. to about 5.0 μm/m-° C., wherein the overall CTE mismatch is the difference between the CTE mismatch of the abrasive grains and the metal bond and the CTE mismatch of the low CTE substrate and the metal bond. As used herein, a CTE mismatch is the absolute difference in CTE between two types of material. Therefore, in the present invention, the overall CTE mismatch is defined as:

$$\text{Overall } CTE \text{ Mismatch} = \left| |CTE_{abrasives} - CTE_{metalbond}| - |CTE_{substrate} - CTE_{metalbond}| \right|,$$

wherein $|CTE_{abrasives} - CTE_{metalbond}|$ is the CTE mismatch of the abrasive grains and the metal bond; and $|CTE_{substrate} - CTE_{metalbond}|$ is the CTE mismatch of the low CTE substrate and the metal bond.

Abrasive grains refer to any grains which can provide abrading, cutting, polishing, grinding or other material removal properties to a tool. A non-exhaustive list of abrasive grains that may be used in embodiments of this invention include oxides, borides, carbides, nitrides, diamond particles, cBN and combinations thereof. In a preferred embodiment, the abrasive grains may be selected from the group consisting of single diamond particles, poly-crystalline diamond particles, alumina, $Si_3N_4$, zirconia, cBN, SiC and combinations thereof.

As used herein, a low CTE substrate is any material that has a CTE that ranges from about 0.1 μm/m-° C. to about 10.0 μm/m-° C. A non-exhaustive list of low CTE substrate materials that may be used in embodiments of this invention include Invar, Super Invar and Kovar. In a preferred embodiment, the low CTE substrate material is selected from the group consisting of Invar 36, Super Invar (Invar 32-5) and Kovar and combinations thereof.

The abrasive grains are coupled to the low CTE substrate material through the metal bond. In embodiments of the present invention, material used to form the metal bond is selected from the group consisting of brazing materials, metal powder bond materials and combinations thereof. A non-exhaustive list of examples of brazing materials include BNi-1, BNi-1a, BNi-2, and BNi-6. A non-exhaustive list of examples of metal powder bond materials include nickel-based and iron-based brazing powder (brazing filler metal). Those skilled in the art will recognize that the selection of materials and the dimensions of the material (e.g., thickness, particle size, etc.) depends on the specifications that one desires to have with a CMP conditioner. Approaches that can be employed to form the metal bond between the abrasive grains and the low CTE substrate material include but are not limited to brazing and sintering.

Those skilled in the art will recognize that prior to bonding the abrasive grains to the low CTE substrate, the grains can be arranged with respect to the metal bonding material and low CTE substrate to form one or more patterns that can be used to form a desired surface topography that aids in conditioning or dressing CMP pads. In embodiments of the invention, each of these patterns can have objects that define a border and accordingly a shape of the pattern. In some embodiments, the shape of the patterns is adjusted to be similar to the shape of the low CTE substrate material (e.g., if the low CTE substrate material has a circular side, then the pattern can have a circular shape). Examples of patterns that can be utilized include a face centered cubic pattern, a cubic pattern, a hexagonal pattern, a rhombic pattern, a spiral pattern, a random pattern, and combinations of such patterns. In addition, one or more sub-patterns and one or more random patterns may be combined to form mixed patterns. Random abrasive grain patterns (e.g., where grains are randomly distributed on the substrate) can be used as well. Besides using patterns that have been placed in either a random distribution or patterned distribution, a self-avoiding random distribution (SARD™) developed by Saint-Gobain Abrasives, Inc. can be used so that there is no repeat pattern, and also no abrasive grain-free zones.

In order to have the abrasive tool attain a CTE mismatch between the metal bond and the low CTE substrate and the abrasive grains and the metal bond that ranges from about 0.1 μm/m-° C. to about 5.0 μm/m-° C., it is desirable to have the abrasive grains, low CTE substrate and the metal bond material have a CTE that make this range possible. In an embodiment of the present invention, the abrasive grains have a CTE that can range from about 1.0 μm/m-° C. to about 8.0 μm/m-° C., the metal bond has a CTE that can range from about 5.0 μm/m-° C. to about 20.0 μm/m-° C., and the low CTE substrate has a CTE that can range from about 1.0 μm/m-° C. to about 10.0μm/m-° C. Note that in these embodiments the CTE values were measured below 300° C.

With respect to the abrasive grains, the low CTE substrate in various embodiments differs by no more than about 100% of the CTE of the abrasive grains. In other embodiments, the low CTE substrate differs by no more than about 50% of the CTE of the abrasive grains. In a preferred embodiment, the low CTE substrate differs by no more than about 20% of the CTE of the abrasive grains.

A result of having an abrasive tool that uses a low CTE substrate that more closely matches the CTE of the abrasive grains is that a surface topography that is flat and consistent can be attained. This correlates to improved CMP conditioners and improved performance during a CMP process. As used herein, surface topography flatness is the peak-to-valley flatness deviation of the CMP conditioner top working surface. A measurement of surface topography is obtained by using a profilometer such as a Micro Measure 3D Surface Profilometer that uses a white light chromatic aberration technique. In certain embodiments, the Micro Measure 3D Surface Profilometer was used herein to profile about a 96 mm by about a 96 mm area of the working surface to measure both flatness and waviness. In such embodiments, the step size used for the scan region was about 70.0 μm in the Y-axis and about 250.0 μm in the X-axis. Flatness parameters such as peak to valley flatness deviation of the surface (FLTt), peak to reference flatness deviation (FLTp), reference to valley flatness deviation (FLTv) and root mean square flatness deviation (FLTq) were calculated according to the ISO 12781 standard on the basis of a surface leveled by the least square method. These values were then low-pass filtered with a user-selected cut-off value to calculate for the full scanned area. In addition, waviness parameters such as arithmetic mean deviation of the assessed profile, root-mean-square (RMS) deviation of the assessed profile, total height of the profile on the evaluation length, maximum profile peak height within a sampling length, maximum profile valley depth within a sampling length and maximum height of the profile within a sampling length were calculated. The values for these parameters were calculated using the ISO 4287 standard which defines waviness parameters on a sampling length and the ISO 4288 standard which provides averages on all available sampling lengths.

In certain embodiments, using the Micro Measure 3D Surface Profilometer in the above-described manner, it has been determined herein that a CMP conditioner formed from the abrasive tool 20 has a surface topography flatness of no more than about 150 μm. In other embodiments, the surface topography flatness may be of no more than about 100 μm. In a preferred embodiment, the surface topography flatness may be of no more than about 70 μm.

A CMP conditioner formed from the abrasive tool described herein is obtained in the following manner. In one embodiment, a low CTE substrate material is used as a preform. A layer of metal bond is applied to the low CTE substrate and a layer of abrasive grains are applied to the metal bond to form an as-made abrasive tool. The as-made abrasive tool is then dried in an oven. In one embodiment, drying the as-made abrasive tool in the oven includes maintaining the abrasive tool in the oven at a temperature of about 260° C. for about 8 hours. After drying, the as-made abrasive tool is fired in a vacuum furnace at a predetermined soaking temperature. In one embodiment, the as-made abrasive tool is fired in a vacuum furnace at a soaking temperature of about 1020° C. for about 40 minutes, where afterwards it is considered that the abrasive tool has been formed. Those skilled in the art will recognize that the soaking temperature and time can vary and that other values may be chosen.

In other embodiments, after the abrasive tool has been formed, a coating can be applied to a working surface. As used herein, a working surface is a surface of an abrasive tool such as a CMP conditioner that during operation faces toward or comes in contact with a CMP pad or other such polishing pad. In one embodiment, the coating is corrosion-resistant. In particular, the coating may be selected from the group consisting of a fluorine-doped nanocomposite coating and a hydrophobic polymeric coating. A non-exhaustive listing of hydrophobic polymeric coatings includes Fluorinated Ethylene Propylene (FEP), parylene, and other fluororesion coatings. Those skilled in the art will recognize that the fluorine-doped nanocomposite coating and hydrophobic polymeric coating can comprise one or more additional dopants. In another embodiment, the coating may be hydrophobic or hydrophilic. Details on aspects of applying a coating to a working surface of a CMP conditioner are provided in commonly assigned U.S. Provisional Patent Application Ser. No. 61/183284, entitled Corrosion-Resistant CMP Conditioning Tools And Methods For Making And Using Same, filed on Jun. 2, 2009, which is incorporated by reference in its entirety. Additional information on diamond-like nanocomposite coatings are described, for example, in U.S. Pat. No. 5,352,493, Method for Forming Diamond-Like Nanocomposite or Doped-Diamond-Like Nanocomposite Films, issued on Oct. 4, 1994 to Dorfman et al., the teachings of which are incorporated herein by reference, in their entirety. Such coatings typically are amorphous materials characterized by interpenetrating random networks of predominantly sp3 bonded carbon stabilized by hydrogen, glass-like silicon stabilized by oxygen and random networks of elements from the 1-7b and 8 groups of the periodic table. Layered structures such as described, for instance, in U.S. Patent Application Serial No. 2008/0193649 A1, Coating Comprising Layered Structures of Diamond-Like Carbon Layers, to Jacquet et al., published on Aug. 14, 2008, the teachings of which are incorporated herein by reference in their entirety, also can be employed.

Figure 3:
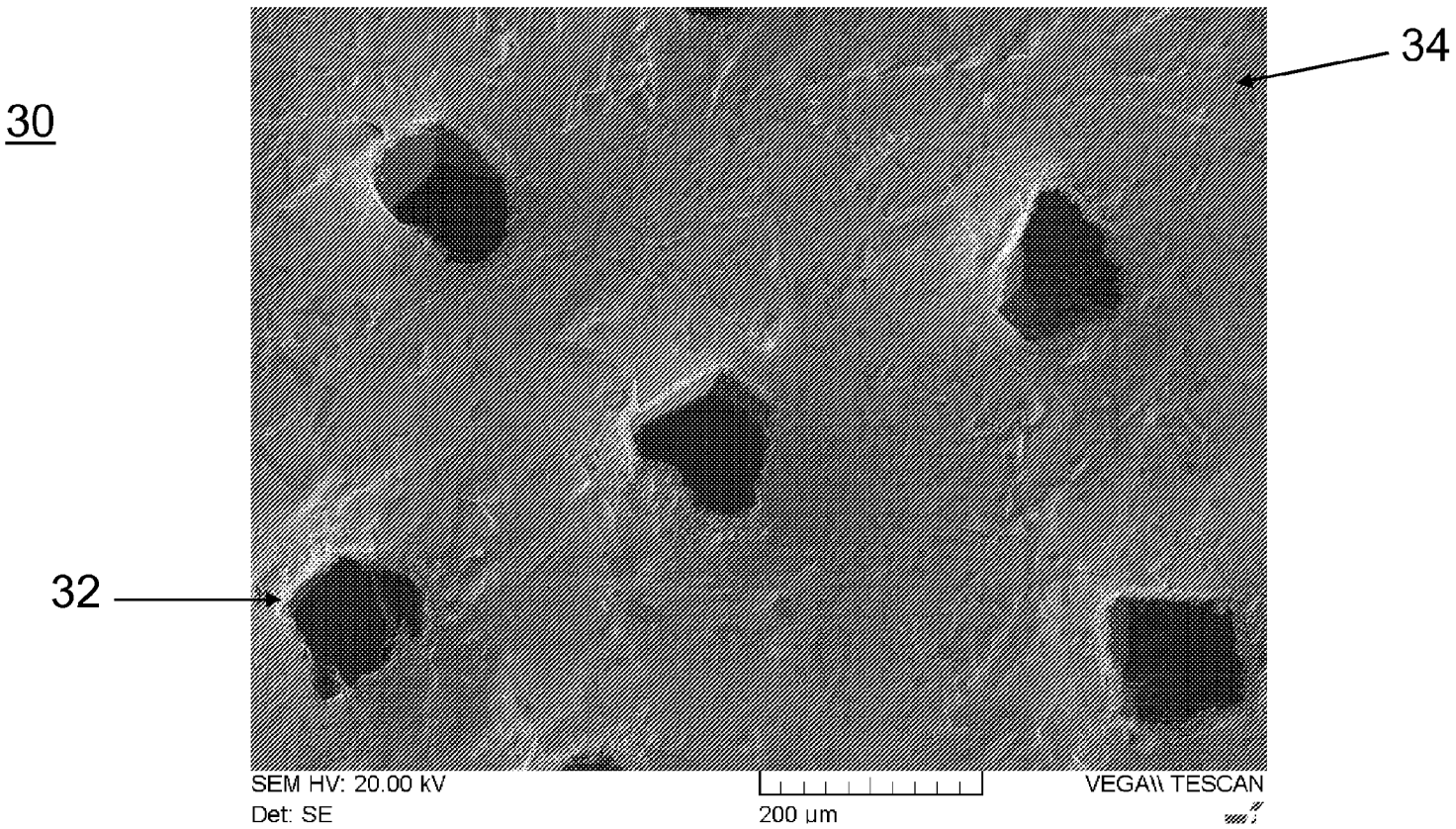
FIG. 3 is a scanning electron microscope image showing the microstructure of the bonding of abrasive grains with a low coefficient of thermal expansion (CTE) substrate according to one embodiment of the present invention.
Figure 4:
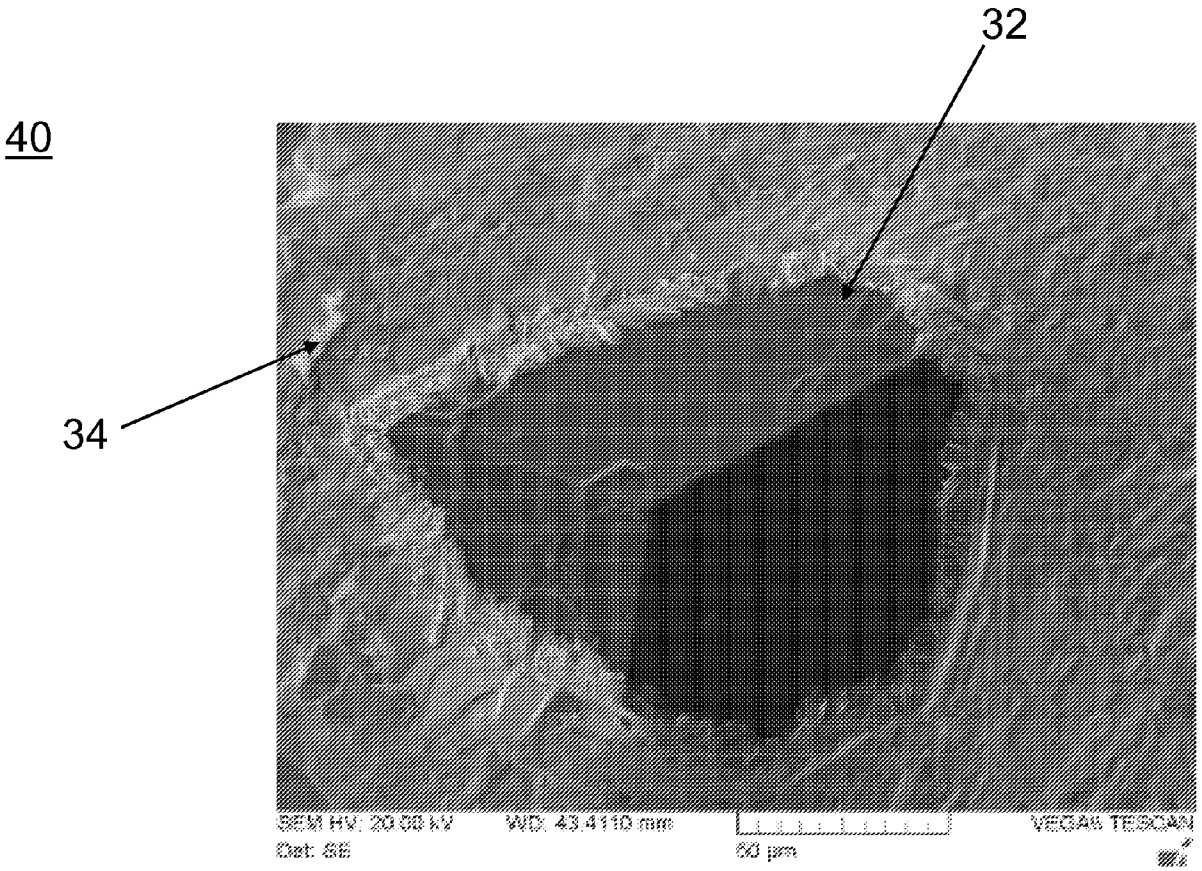
FIG. 4 is a scanning electron microscope image showing a more detailed microstructure view of an abrasive grain shown in FIG. 3.

FIGS. 3 and 4 show scanning electron microscope images showing the microstructure of the bonding of abrasive grains with a low CTE material substrate. In particular, the scanning electron microscope image 30 of FIG. 3 shows the microstructure of the bonding of abrasive grains 32 firmly bonded to a low CTE substrate 34, while the scanning electron microscope image 40 of FIG. 4 shows further detail of the strength of the chemical bonding between a particular abrasive grain 32 and the low CTE substrate 34. In both images, the chemical bonding of the abrasive grains 32 is firmly in place with the low CTE substrate 34 and it is unlikely that the grains will be displaced.

After formation of the CMP conditioner from the abrasive tool described herein, the conditioner is ready to be used to condition or dress a CMP pad. In one embodiment, a working surface of the CMP pad is contacted by the CMP conditioner. Refurbishing of the CMP pad begins in response to the CMP conditioner making contact with the working surface of the CMP pad during conditioning or dressing operations.

EXAMPLES

The following provides particular examples of CMP conditioner abrasive tools formed according to embodiments described herein.

Example 1

Figures 5, 6:
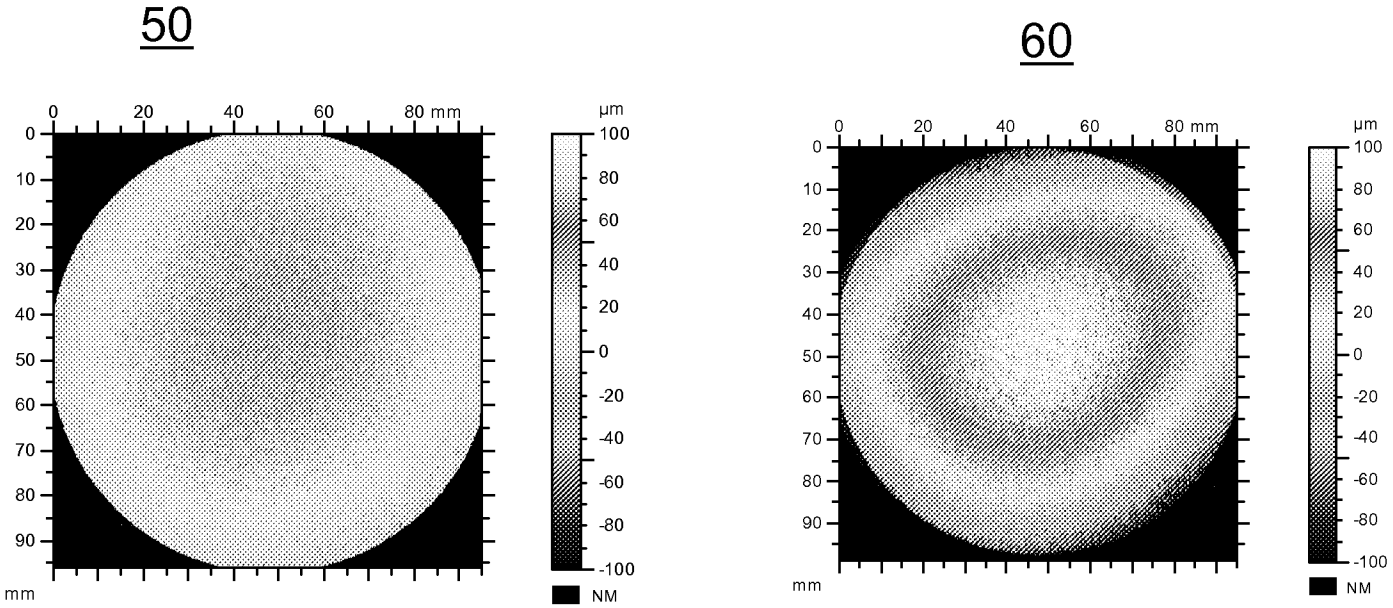
FIG. 5 is an image of an abrasive tool made from a low CTE substrate having a flat and consistent surface topography.
FIG. 6 is an image of an abrasive tool made from a stainless steel substrate having a non-flat and inconsistent surface topography.

In this example, a CMP conditioner was formed from an abrasive tool comprising abrasive grains coupled to a low CTE substrate through a metal bond. In this example, the abrasive grains were diamond particles, the metal bond was NICROBRAZE and the low CTE substrate was Invar. The abrasive tool used to form the CMP conditioner in this example was formed in the aforementioned manner. After formation of the CMP conditioner, the Micro Measure 3D Surface Profilometer was used to measure surface topography flatness and waviness. As shown in image 50 of FIG. 5, the surface topography of the CMP conditioner is generally even and uniform and that there is no indication of severe deformation.

Comparative Example 1

In this example, a CMP conditioner was formed from an abrasive tool comprising abrasive grains coupled to a stainless steel substrate through a metal bond. In this example, the abrasive grains were diamond particles, the metal bond was NICROBRAZE and the stainless steel substrate was 430SS. This abrasive tool was used to form a CMP conditioner in the aforementioned manner and the Micro Measure 3D Surface Profilometer was used to measure surface topography flatness and waviness. As shown in image 60 of FIG. 6, the surface topography is uneven and non-uniform because of the deformation that arises because of the CTE mismatch between the 430SS substrate and the composite layer of the abrasive grains and metal bond. The CMP conditioner made with the low CTE substrate Invar is much flatter than the CMP conditioner made with the stainless steel 430SS substrate

Comparative Example 2

Figure 7:
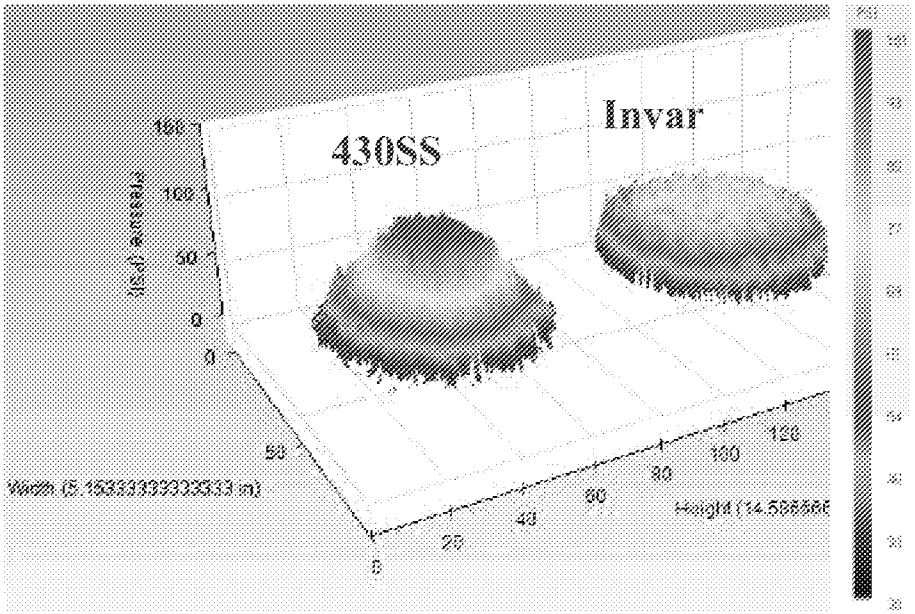
FIG. 7 is an image comparing the working surface of the abrasive tool having a low CTE substrate to the working surface of the abrasive tool having a stainless steel substrate as a similar load is applied to each surface.

In this example, the CMP conditioner made from the low CTE substrate Invar as set forth in Example 1 and the CMP conditioner made from the 430 SS substrate as set forth in Comparative Example 1 were put under the same load to determine the life time and performance of each conditioner. In this example, a pressure sensor sensitive film was placed on the top working surface of the CMP conditioner. Then a load that may range from about 10 lbs to about 500 lbs was placed on the top working surface of the CMP conditioner. After unloading, the surface was analyzed to determine the topography of the working surface of the CMP conditioner. In this example, as shown in image 70 of FIG. 7, the CMP conditioner made from the low CTE substrate Invar has a uniform working surface and therefore more of the abrasive grains will be involved in the CMP conditioning. Thus, this CMP conditioner will have improved life time and performance consistency. On the other hand, the CMP conditioner made from the 430 SS substrate has a non-uniform working surface and therefore more of the abrasive grains will not be involved in the CMP conditioning. Thus, the performance of this CMP conditioner is not as good as the CMP conditioner having the low CTE substrate Invar.

Example 2

In this example, a CMP conditioner was formed from an abrasive tool comprising abrasive grains coupled to a low CTE substrate through a metal bond. In particular, the abrasive grains were diamond particles, the metal bond was NICROBRAZE and the low CTE substrate was Invar. The NICROBRAZE was applied to the Invar and the diamond particles were applied to the NICROBRAZE to form an as-made abrasive tool. The as-made abrasive tool was dried in the oven at a temperature of about 260° C. for about 8 hours. After drying, the as-made abrasive tool was fired in a vacuum furnace at a predetermined soaking temperature of about 1020° C. for about 20 minutes to form the abrasive tool. After formation of the abrasive tool, a fluorine-doped nanocomposite coating was applied to a working surface of the abrasive tool.

The abrasive tool formed in this example was used as a CMP conditioner to condition a CMP pad of an AMAT Mira CMP Machine that was used to planarize or polish semiconductor wafers. The polishing parameter settings for the AMAT Mira CMP Machine included the platen speed, wafer head speed, membrane pressure and slurry amount, while the conditioning parameter settings included the mode, down force and disk head speed. In this example, the platen speed was set at 93 revolutions per minute (RPM), wafer head speed was set at 87 RPM, membrane pressure was set at 3 pounds per square inch (PSI) and slurry amount was set at 200 mil liters per minute (ml/min), the mode was in-situ, down force was set at 7 pounds per force (lbf) and disk head speed was set at 93 RPM.

Figure 8A:
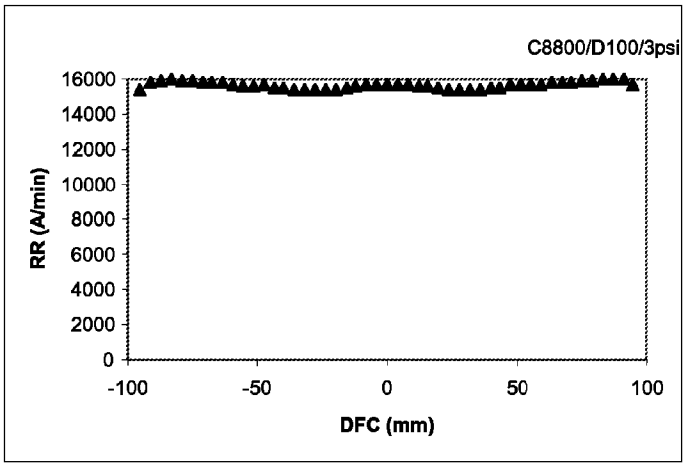
FIGS. 8A-8B are plots illustrating wafer uniformity for wafers polished by a chemical-mechanical polishing (CMP) machine conditioned by an abrasive tool formed according to one embodiment of the present invention.
Figure 8B:
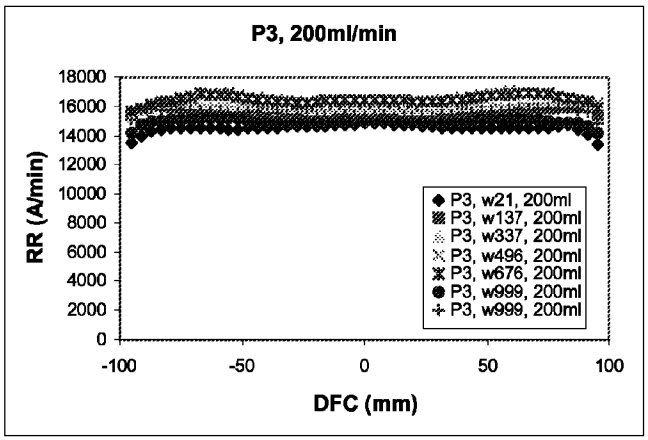

FIGS. 8A-8B are plots illustrating wafer uniformity for wafers polished by the AMAT Mira CMP Machine that was conditioned by the CMP conditioner formed in this example. In particular, FIG. 8A shows a plot 80 of the removal rate (RR) of a wafer with the CMP machine as measured from the edge of the wafer to its center and to the other edge (distance from the center (DFC)) after a polishing operation. FIG. 8B also shows a plot 85 of the RR versus the DFC, but after a greater number of wafers have been polished at particular different times. In particular, FIG. 8B shows the polishing results after the AMAT Mira CMP Machine was used to polish up to 999 wafers. The measurements were taken after the polishing of wafer 21, wafer 137, wafer 337, wafer 496, wafer 676, and wafer 999. The plots of FIGS. 8A-8B both show that the AMAT Mira CMP Machine aided by the CMP conditioner formed in this example generated wafer profiles that were flat and consistent as measured from one edge of the wafers to their centers and to the other edge of the wafers (note that the measurements plotted in FIGS. 8A-8B were obtained by using a full point probe to scan the wafers after performing each polishing operation). These results demonstrate that a CMP conditioner formed from diamond particles, NICROBRAZE and Invar and coated with a fluorine-doped nanocomposite coating directly affects wafer profiles in a manner that leads to more uniform wafer profiles that are consistently flat.

Figure 9:
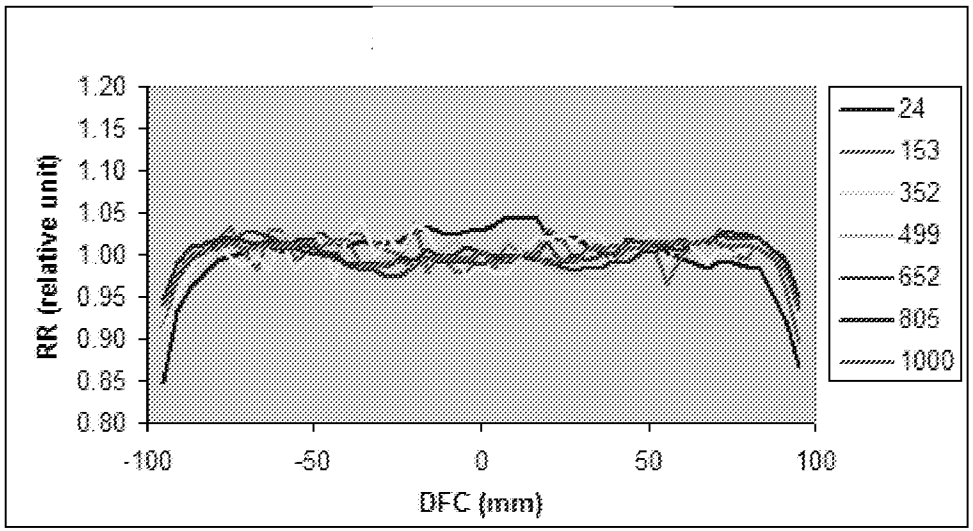
FIG. 9 is a plot illustrating the repeatability of the wafer uniformity results shown in FIGS. 8A-8B.

In order to ensure that the results illustrated in FIGS. 8A-8B were repeatable, another CMP conditioner as described above for this example was made and used in conjunction with the same AMAT Mira CMP Machine to polish wafers under the same machine parameters settings. The wafer profile measurements of these wafers are illustrated in plot 90 of FIG. 9. In particular, FIG. 9 shows again that the AMAT Mira CMP Machine aided by the CMP conditioner of this example generated wafer profiles that were flat and consistent as measured from one edge of the wafers to their centers and to their other edge. More specifically, FIG. 9 shows that the wafer profiles stayed consistently flat over 1000 wafer polishing operations which extended over approximately 18 hours of testing. Thus, plot 90 of FIG. 9 shows that the results in FIGS. 8A-8B for a CMP conditioner formed from diamond particles, NICROBRAZE and Invar and coated with a fluorine-doped nanocomposite coating were repeatable and demonstrates that this CMP conditioner assisted in generating consistent and uniform wafer profiles.

Figure 10A:
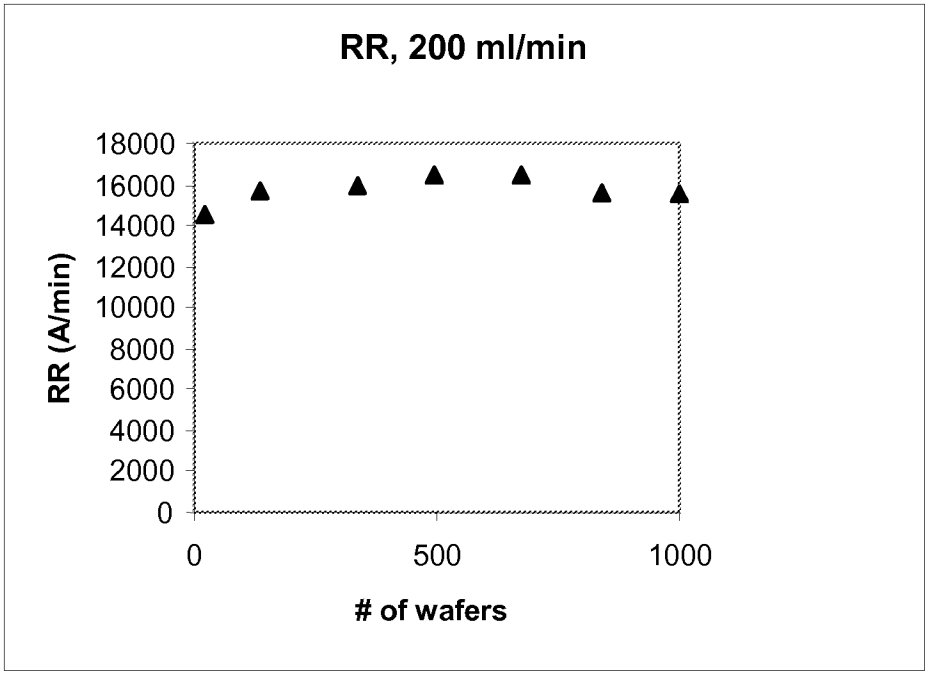
FIGS. 10A-10B are plots illustrating wafer removal rate and removal rate range stability for wafers polished by a CMP machine conditioned by an abrasive tool formed according to one embodiment of the present invention.
Figure 10B:
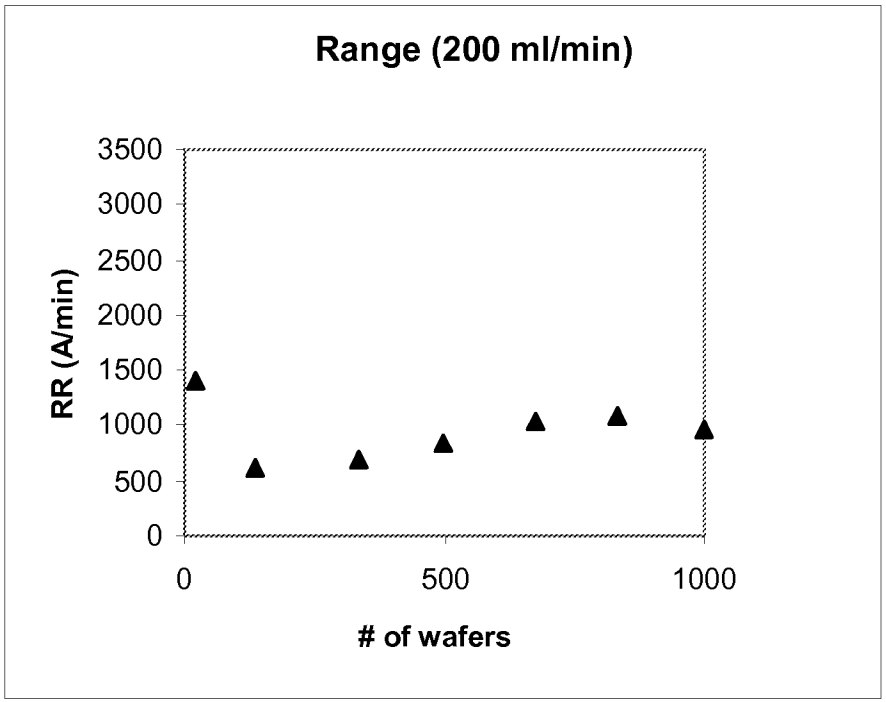

FIGS. 10A-10B show other plots illustrating how the CMP conditioner formed from diamond particles, NICROBRAZE and Invar and coated with a fluorine-doped nanocomposite coating, has a positive effect on the polishing of wafers. In particular, FIG. 10A shows a plot 100 of the removal rate (RR) versus the number of wafers polished with the AMAT Mira CMP Machine and the CMP conditioner of this example. In particular, FIG. 10A shows that the RR from 0 to wafer 1000 was stable and consistent. FIG. 10B shows a plot 110 illustrating the range of the RR over the number of wafers polished. As used herein, the range of the RR is the maximum RR minus the minimum RR. As shown in FIG. 10B, the range of the RR is minimal for over 1000 wafer polishings and this is indicative of a very stable removal rate. This demonstrates that a CMP conditioner formed from diamond particles, NICROBRAZE and Invar and coated with a fluorine-doped nanocomposite coating directly affects wafer profiles in a manner that leads to more uniform wafer profiles that are consistently flat.

While the disclosure has been particularly shown and described in conjunction with preferred embodiments thereof, it will be appreciated that variations and modifications will occur to those skilled in the art. Therefore, it is to be understood that the appended claims are intended to cover all such modifications and changes as fall within the true spirit of the disclosure.

What is claimed is:

1. An abrasive tool, comprising:

abrasive grains coupled to a substrate through a metal bond, wherein there is an overall coefficient of thermal expansion mismatch that ranges from about 0.1 μm/m-° C. to about 5.0 μm/m-° C., wherein the overall coefficient of thermal expansion mismatch is the difference between a coefficient of thermal expansion mismatch of the abrasive grains and the metal bond and a coefficient of thermal expansion mismatch of the substrate and the metal bond, and wherein the low coefficient of thermal expansion substrate is selected from the group consisting of Invar, Invar 36, Super Invar, Kovar, and a combination thereof.

2. The abrasive tool according to claim 1, wherein the overall coefficient of thermal expansion mismatch ranges from about 0.1 μm/m-° C. to about 1.0 μm/m-° C.

3. The abrasive tool according to claim 1, wherein the abrasive tool comprises a chemical-mechanical polishing conditioner.

4. The abrasive tool according to claim 3, wherein the chemical-mechanical polishing conditioner has a surface topography flatness of no more than about 150 μm.

5. The abrasive tool according to claim 3, wherein the chemical-mechanical polishing conditioner comprises a coating applied to a working surface of the chemical-mechanical polishing conditioner.

6. The abrasive tool according to claim 5, wherein the coating is selected from the group consisting of a fluorine-doped nanocomposite coating and a hydrophobic polymeric coating.

7. The abrasive tool according to claim 6, wherein the hydrophobic polymeric coating is selected from the group consisting of a fluorinated ethylene propylene coating, a parylene coating, another flouroresion coating, and a combination thereof.

8. The abrasive tool according to claim 6, wherein the coating includes one or more additional dopants.

9. The abrasive tool according to claim 1, wherein the abrasive grains have a coefficient of thermal expansion that ranges from about 1.0 μm/m-° C. to about 8.0 μm/m-° C.

10. The abrasive tool according to claim 1, wherein the metal bond has a coefficient of thermal expansion that ranges from about 5.0 μm/m-° C. to about 20.0 μm/m-° C.

11. The abrasive tool according to claim 1, wherein the substrate has a coefficient of thermal expansion that ranges from about 1.0 μm/m-° C. to about 10.0 μm/m-° C.

12. The abrasive tool according to claim 1, wherein the abrasive grains are selected from the group consisting of an oxide, a boride, a carbide, a nitride, a diamond particle, a poly-crystalline diamond particle, alumina, $Si_3N_4$, zirconia, cBN, SiC, and a combination thereof.

13. The abrasive tool according to claim 1, wherein the metal bond includes material selected from the group consisting of a brazing material, a metal powder bond material, and a combination thereof.

14. The abrasive tool according to claim 13, wherein the brazing material is selected from the group consisting of BNi-1, BNi-1a, BNi-2, BNi-6, and a combination thereof.

15. The abrasive tool according to claim 13, wherein the metal powder bond material is selected from the group consisting of a Ni-based brazing powder, a Fe-based brazing powder, and a combination thereof.

16. The abrasive tool according to claim 1, wherein a coefficient of thermal expansion of the substrate differs from a coefficient of thermal expansion of the abrasive grains by no more than about 100%.

17. An abrasive tool, comprising:

abrasive grains coupled to a substrate through a metal bond, wherein there is an overall coefficient of thermal expansion mismatch that ranges from about 0.1 μm/m-° C. to about 5.0 μm/m-° C., wherein the overall coefficient of thermal expansion mismatch is the difference between a coefficient of thermal expansion mismatch of the abrasive grains and the metal bond and a coefficient of thermal expansion mismatch of the substrate and the metal bond, and wherein the abrasive grains are arranged according to a self-avoiding random distribution.

* * * * *